US009834377B1

(12) United States Patent
Hayes et al.

(10) Patent No.: US 9,834,377 B1
(45) Date of Patent: Dec. 5, 2017

(54) LIFTING ARM ASSEMBLY FOR AUTOMATED SIDE LOADER USED ON REFUSE COLLECTION VEHICLE

(71) Applicant: Loadmaster Corporation, Norway, MI (US)

(72) Inventors: Forrest Edward Hayes, Norway, MI (US); David J. Brisson, Norway, MI (US)

(73) Assignee: Loadmaster Corporation, Norway, MI (US)

( * ) Notice: Subject to any disclaimer, the term of this patent is extended or adjusted under 35 U.S.C. 154(b) by 241 days.

(21) Appl. No.: 14/960,734

(22) Filed: Dec. 7, 2015

Related U.S. Application Data

(60) Provisional application No. 62/092,056, filed on Dec. 15, 2014.

(51) Int. Cl.
*B65F 3/04* (2006.01)
*B65F 3/02* (2006.01)

(52) U.S. Cl.
CPC ..... *B65F 3/041* (2013.01); *B65F 2003/023* (2013.01)

(58) Field of Classification Search
CPC ..... B66C 1/663; B66C 1/625; B66C 1/28; B66C 1/30; B66C 1/101; B66C 3/005; B66C 3/02; B65F 3/04; B65F 3/041; B65F 3/043; B65F 3/046; B65F 3/048; B65F 3/06; B65F 2003/0223; B65F 2003/0226; B65F 2003/023; B65F 2003/025; B60P 1/4421; B60P 1/4428; B60P 1/4442; B60P 1/48; B60P 1/28; B60P 1/283; B60P 1/286; B60P 1/34; B66F 9/183; B66F 9/187
See application file for complete search history.

(56) References Cited

U.S. PATENT DOCUMENTS 3,822,802 A * 7/1974 Evans, Jr. ..... B65F 3/00 414/373
4,597,710 A 7/1986 Kovats
5,007,786 A 4/1991 Bingman
5,163,805 A 11/1992 Mezey
5,230,393 A * 7/1993 Mezey ..... B65F 3/08 177/139
5,702,225 A 12/1997 Ghibaudo
6,491,489 B1 * 12/2002 Stragier ..... B65F 3/046 414/409

(Continued)

*Primary Examiner* — Glenn Myers
(74) *Attorney, Agent, or Firm* — Andrus Intellectual Property Law, LLP

(57) ABSTRACT

A lifting arm assembly is movable between a grabbing position and tipping position and includes a static frame provided with a roller arrangement. A dynamic frame is mounted for vertical movement relative to the static frame. A grabber structure is provided with a pair of grabber arms configured for movement between a closed position and an open position. A linkage arrangement has a first end pivotally connected to the dynamic frame, and a second end pivotally attached to the grabber structure. The first end includes a set of teeth arranged in meshing engagement with the roller arrangement on the static frame. Movement of the dynamic frame relative to the static frame causes pivoting of the linkage arrangement resulting in lifting movement of the grabber structure along a curvilinear path between the grabbing position and the tipping position.

18 Claims, 11 Drawing Sheets

(56) References Cited

U.S. PATENT DOCUMENTS

| | | | | |
|---|---|---|---|---|
| 6,821,074 | B2 | 11/2004 | Schreiber et al. | |
| 7,559,735 | B2 * | 7/2009 | Pruteanu ..... | B65F 3/046<br>414/409 |
| 2002/0154973 | A1 | 10/2002 | Bradshaw et al. | |
| 2009/0025378 | A1 | 1/2009 | Laumer et al. | |

* cited by examiner

LIFTING ARM ASSEMBLY FOR AUTOMATED SIDE LOADER USED ON REFUSE COLLECTION VEHICLE

CROSS REFERENCE TO RELATED APPLICATION

The present utility application relates to and claims priority to U.S. Provisional Patent Application Ser. No. 62/092,056 filed Dec. 15, 2014, which is herein incorporated by reference in entirety.

FIELD

The present disclosure relates generally to an extendable and retractable automated side loader used in refuse collection, and more particularly, pertains to a lifting arm assembly of the automated side loader.

BACKGROUND

To increase the efficiency of refuse collection, many refuse collection companies use automated refuse loaders that lift a filled refuse container, and then dump the contents of the refuse container into a refuse collection vehicle. Such automated refuse loaders can service a significantly higher number of customers in a given time period when compared with manually placing refuse into the refuse collection vehicle. This increased efficiency can result in substantially lower refuse collection costs.

Some refuse collection vehicles utilized a cantilevered lifting arm assembly that lifts the refuse container and then dumps the refuse container into a refuse collection vehicle. Such mechanical lifting arm assembly may be mounted on the side of a refuse collection vehicle to permit refuse to be collected as the refuse collection vehicle is driven along a road.

One known type of lifting arm assembly used in automated side loaders relies upon chains wrapped around an axle with one end affixed to the axle, and another end anchored to a static frame and held in tension to induce rotation in a sliding frame that lifts a gripper arrangement. Such design as been found to be problematic because the chains require frequent adjustment to maintain the proper level of tension. In addition, the linkage geometry used in this type of known design leads to occasional spillage of refuse from the waste container being lifted and dumped into the refuse collection vehicle, and requires greater forces than desired to induce the rotation needed during emptying of the waste container.

Through research and experimentation, the inventor has determined that a need exists to design and construct a lifting arm assembly to better facilitate the efficient grasping, lifting and unloading of a waste container relative to a refuse collection vehicle and to overcome problems of prior art designs.

SUMMARY

In one example, the present disclosure relates to a lifting arm assembly movable between a grabbing position and a tipping position. The lifting arm assembly includes a static frame provided with a roller arrangement, and a dynamic frame mounted for vertical movement relative to the static frame. A grabber structure is provided with a pair of grabber arms configured for movement between a closed position and an open position. A linkage arrangement is provided having a first end pivotally connected to the dynamic frame, and a second end pivotally attached to the grabber structure. The first end includes a set of teeth arranged in meshing engagement with the roller arrangement on the static frame. Movement of the dynamic frame relative to the static frame causes pivoting of the linkage arrangement resulting in lifting movement of the grabber structure along a curvilinear path between the grabbing position and the tipping position.

In a further example, the present disclosure relates to a lifting arm assembly movable between a grabbing position and a tipping position, and adapted to be used in securing, lifting and emptying a waste container into a refuse collection vehicle. The lifting arm assembly includes a static frame adapted to be secured to an extendable and retractable movement mechanism mounted on the refuse collection vehicle. The static frame is provided with a roller arrangement. A dynamic frame is slidably mounted for vertical movement within the static frame. A grabber structure is provided with a pair of grabber arms configured for movement between a closed position and an open position, and is adapted to engage the waste container. A drive arm arrangement has a first end pivotally coupled to the dynamic frame, and a second end pivotally joined to the grabber structure. A control link has a first end pivotally attached to the dynamic frame, and a second end pivotally secured to the grabber structure. A first extendable and retractable piston cylinder is mounted in the static frame for vertically moving the dynamic frame within the static frame. The first piston cylinder has a base end fixed to the static frame, and a rod end joined to the dynamic frame. A second extendable and retractable piston cylinder is mounted on the grabber structure for moving the grabber arms between the opened and closed positions. The first end of the drive arm arrangement is formed as a sprocket having a plurality of teeth arranged in meshing arrangement with the roller arrangement on the static frame. Actuation of the second piston cylinder is adapted to cause the grabber arms to engage the waste container, and actuation of the first piston cylinder causes vertical movement of the dynamic frame within the static frame such that the control link and the drive arm arrangement are pivoted resulting in movement of the grabber structure along a curvilinear path between the grabbing position and the tipping position.

DETAILED DESCRIPTION

Figure 1A:
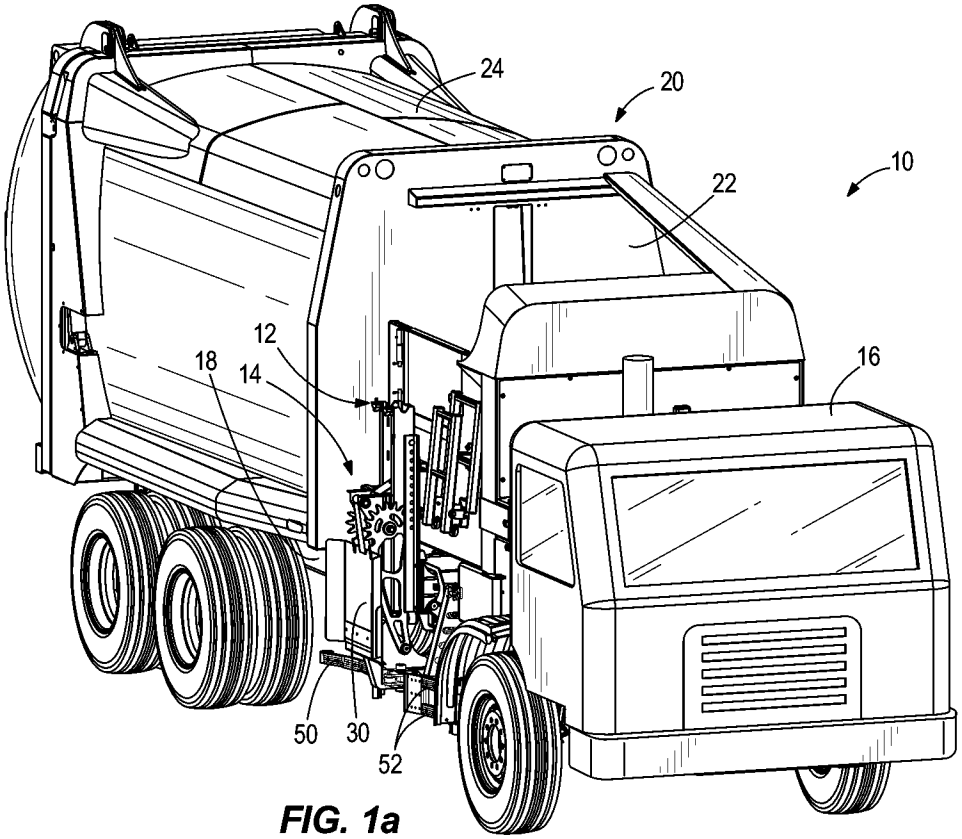
FIG. 1*a* is a side perspective view of a refuse collection vehicle equipped with an automated side loader including a lifting arm assembly of the present disclosure shown in a retracted position.
Figure 1B:
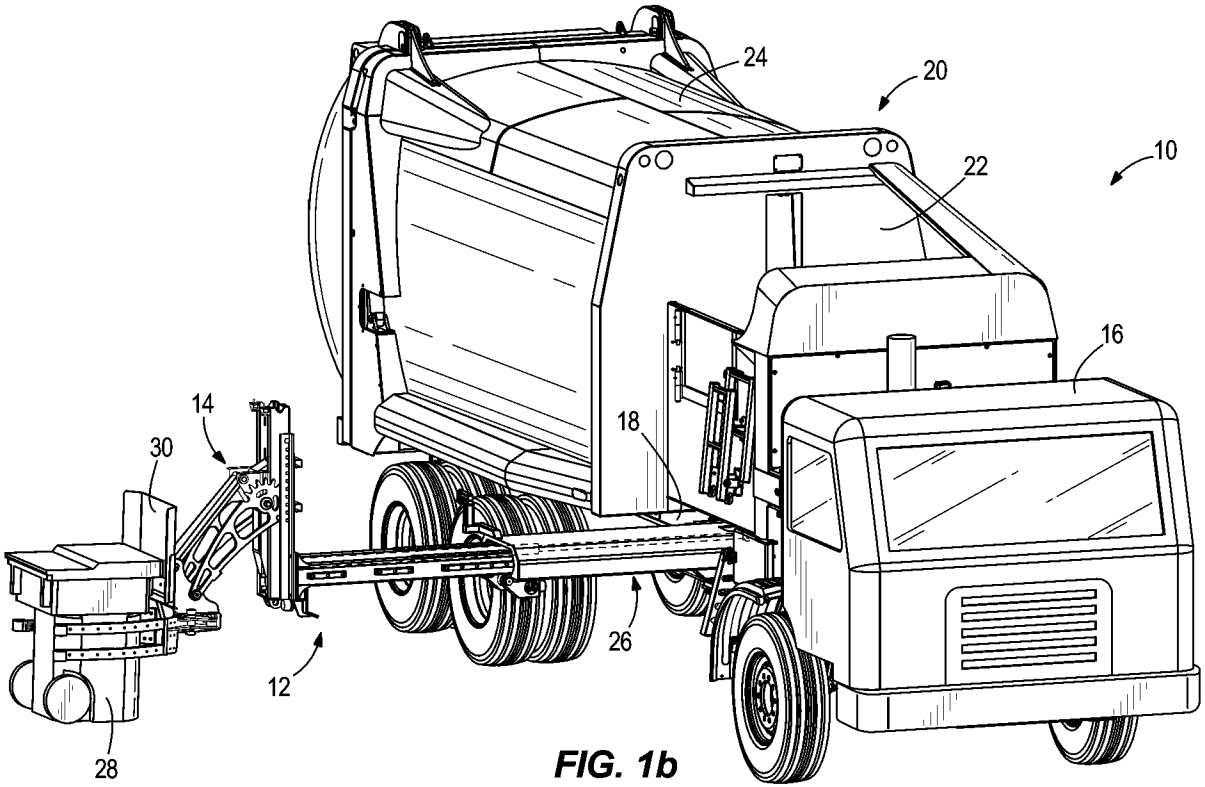
FIG. 1*b* is a view similar to FIG. 1*a* showing the lifting arm assembly in an extended grabbing position.
Figure 1C:
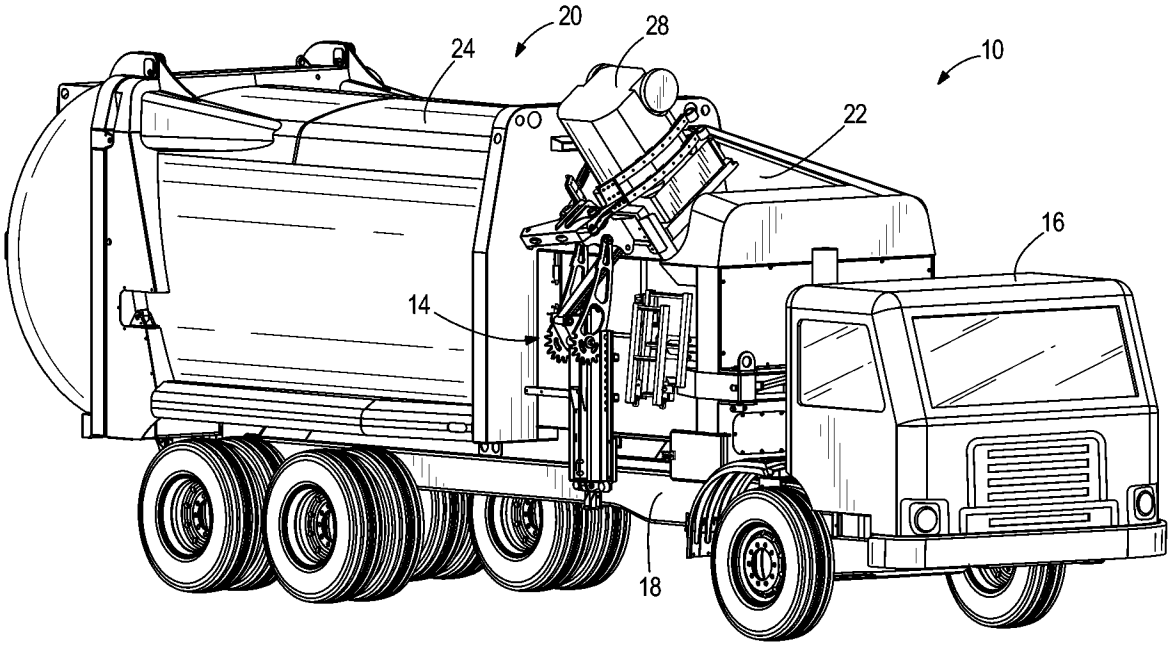
FIG. 1*c* is a view similar to FIGS. 1*a* and 1*b* showing the lifting arm assembly in a tipped dumping position.
Figure 2:
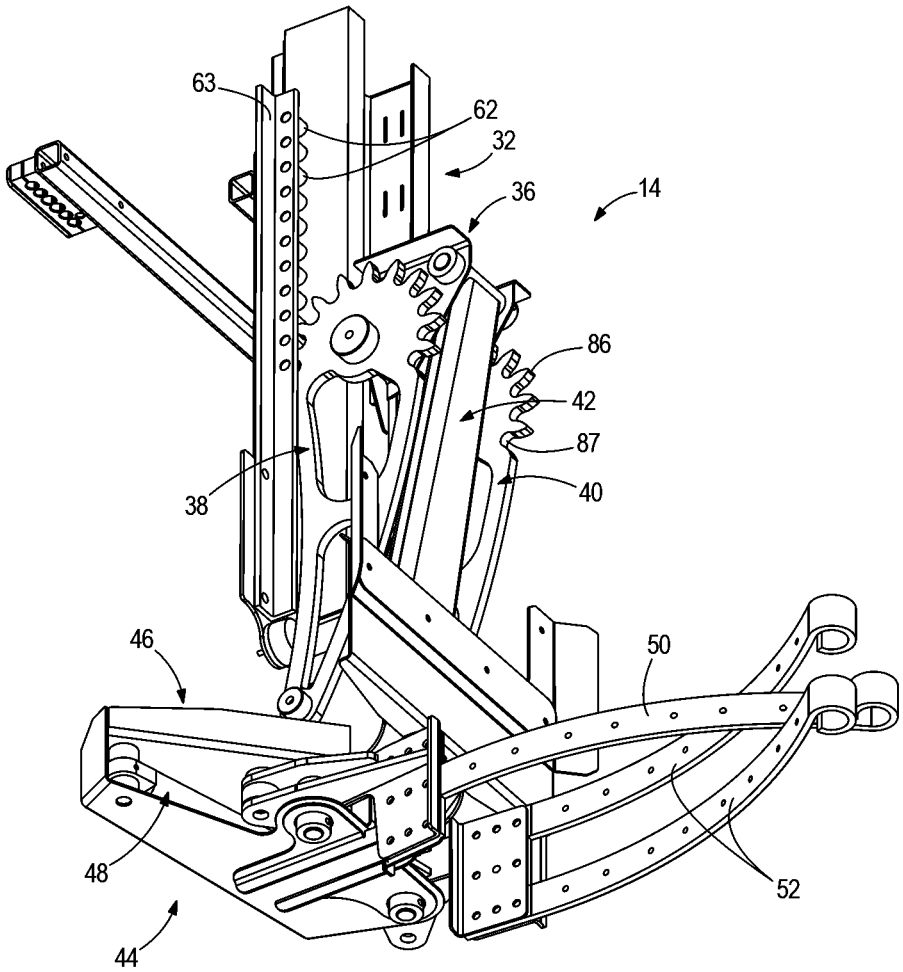
FIG. 2 is a bottom perspective view of the lifting arm assembly in a lowermost position.

Referring now to the drawings, FIGS. 1*a*, 1*b* and 1*c* illustrate a refuse collection vehicle 10 equipped with an automated side loader 12 including a lifting arm assembly 14 in accordance with the present disclosure.

The refuse collection vehicle 10 includes a vehicle cab 16 and a chassis 18 having a vehicle body 20 mounted thereto. The vehicle body 20 is configured with a forward receiving hopper 22 for collection of waste materials, such as from curbside waste containers, and a rearward storage compartment 24 for compacted waste. The automated side loader 12 is constructed with the lifting arm assembly 14 for securing, lifting and tipping waste containers filled with refuse into the receiving hopper 22. The automated side loader 12 is mounted on a side of the refuse collection vehicle 10, and typically includes an extendable and retractable movement mechanism 26 connected to the lift arm assembly 14 for laterally extending and retracting the lifting arm 14 between a waste container 28 and the side of the refuse collection vehicle 10. The lifting arm assembly 14 is provided with an outwardly facing, shield-like chute 30 which engages against an outer surface of the waste container 28 when it is desired to empty refuse therefrom.

Figure 3:
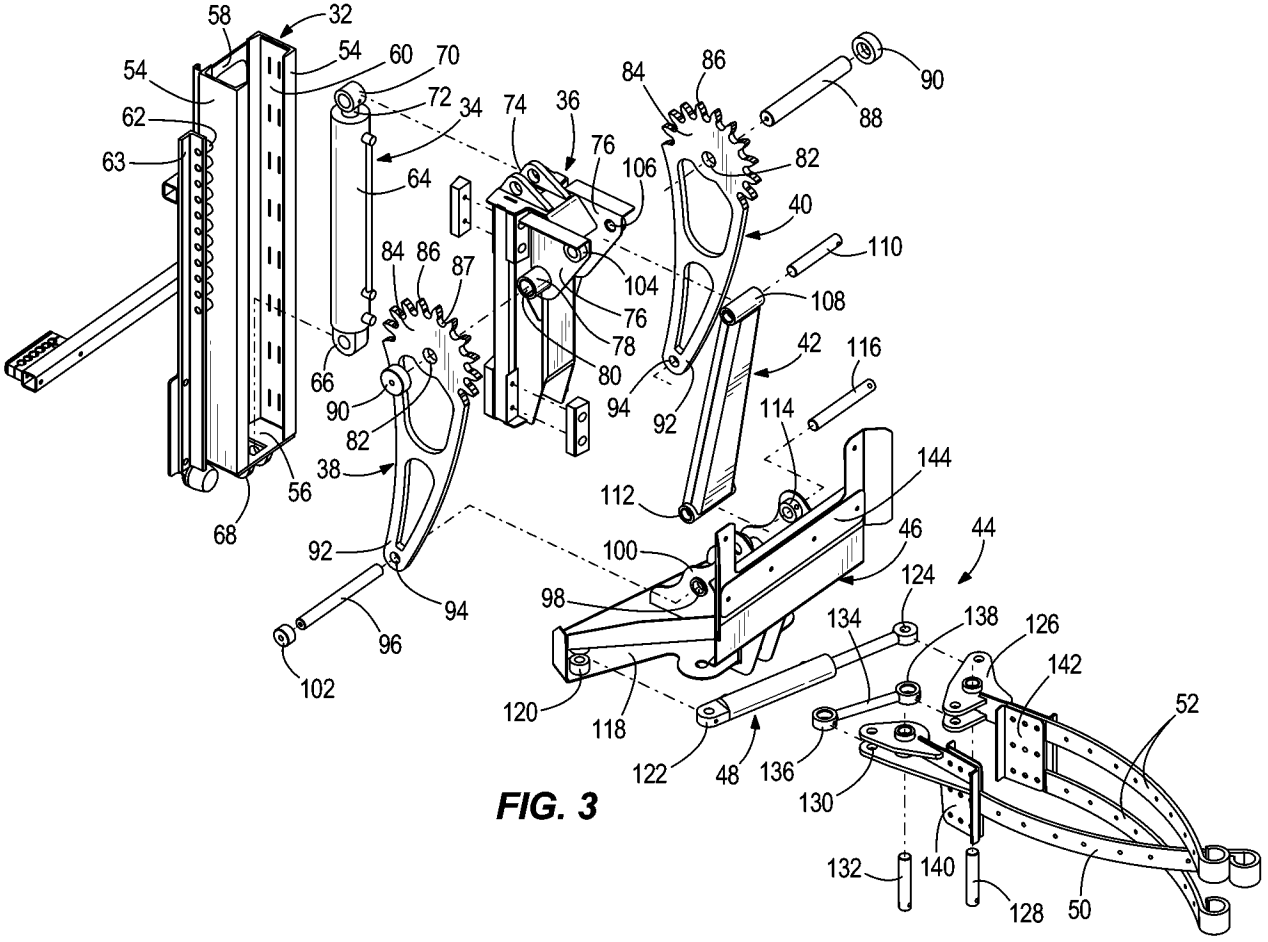
FIG. 3 is an exploded perspective view of the lifting arm assembly.

Referring now to FIGS. 2-6, and in particular to FIG. 3, the lifting arm assembly 14 is basically comprised of a static frame 32, a fluid actuated lift piston cylinder 34, a dynamic sliding frame 36, a pair of spaced apart sprocket arms 38, 40 defining a drive arm arrangement, a control link 42, and a grabber structure 44 defined by a grabber frame 46, a fluid actuated grabber piston cylinder 48 and a pair of grabber arms 50, 52 which are movable between a closed position and an open position.

The static frame 32 is constructed from a pair of C-shaped channels 54 connected to a bottom plate 56 and a rear backward plate 58. Wear plates 60 are provided along the entire lengths of oppositely facing inside surfaces of the C-shaped channels 54. A series of vertically aligned spaced apart rollers 62 are provided between the outside surface of each C-shaped channel 54 and an elongated L-shaped channel 63. The L-shaped channels 63 are attached to the backward plate 58 and are spaced from the C-shaped channels 54 as seen best in FIG. 6. The lift piston cylinder 34 is designed to be mounted within the static frame 32 and to provide powered vertical movement ultimately lifting and tilting the grabber structure 44 as will be better understood below. The lift piston cylinder 34 has a casing 64 with a base end 66 which extends through an opening in the bottom plate 56 between spaced apart ears of a bottom cylinder mount 68 at which location it is fixed by a suitable retainer. The lift piston cylinder 34 has a rod eye 70 mounted on a rod 72 which is vertically extendable and retractable relative to the casing 64.

The dynamic sliding frame 36 is slidably received and retained within the static frame 32, and is configured to rearwardly receive the lift piston cylinder 34 such that the rod eye 70 is suitably connected between spaced apart ears of a top cylinder mount 74. The sliding frame 36 has a pair of forward side plates 76 which provide upward pivotal mounting positions for the sprocket arms 38, 40 and the control link 42.

More specifically, tubular extensions 78 projecting laterally from the side plates 76 form passages 80 that are aligned with openings 82 in upper ends 84 of the sprocket arms 38, 40. The upper ends 84 are formed as sprockets with a number of spaced apart teeth 86 which are radially spaced from the opening 82. Valleys 87 are formed on each side of the teeth 86 for receiving the rollers 62. An axle 88 is passed through the aligned extensions 78, passages 80, and openings 82 to define an upper pivotal mounting for the sprocket arms 38, 40 which are held pivotally mounted to opposite sides of the side plates 76 of the sliding frame 36 by placing axle caps 90 on opposite sides of the axle 88. With the upper ends of the sprocket arms 38, 40 pivotally mounted to the sliding frame 36, the teeth 86 will be in meshing engagement between the rollers 62 provided on the sides of the static frame 32.

Bottom ends 92 of the sprocket arms 38, 40 have aligned apertures 94 which receive a pivot pin 96 that extends across tube 98 connecting spaced apart side plates 100 on the grabber frame 46. The pivot pin 96 defines a lower pivotal mounting for the sprocket arms 38, 40 which are held pivotally mounted to the grabber frame 46 by placing axle caps 102 on opposite ends of the pivot pin 96.

The side plates 76 of the sliding frame 36 are also provided with collars 104 in communication with holes 106 aligned with a passageway formed through a cross tube 108 formed on the upper end of the control link 42. A pivot pin 110 is passed through the aligned collars 104, holes 106 and the cross tube 108 to define an upper pivotal mounting for the control link 42. Set screws may be screwed into the collars 104 against the pin 110 to maintain the upper pivotal mounting of the control link 42. A lower end of the control link 42 has a cross tube 112 which is positioned between inwardly facing collars 114 provided on side plates 100 of the grabber frame 46. A pivot pin 116 is passed through the aligned cross tube 112 and collars 114, and held in place by using set screws screwed into the collars 114 against the pin 116. The pin 116 thus defines a lower pivotal mounting for the control link 42.

Figure 4:
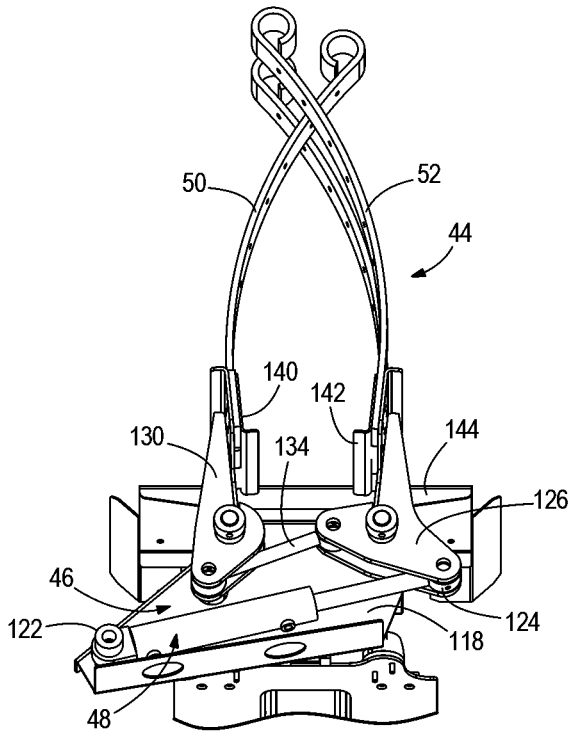
FIG. 4 is an isolated detail view of a grabber structure of the lifting arm assembly showing a pair of grabber arms in a closed position.
Figure 5:
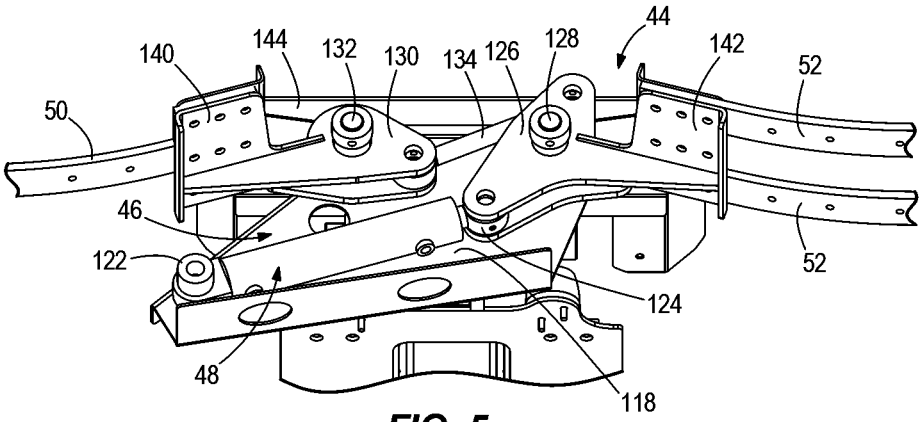
FIG. 5 is another isolated detail view of a grabber structure showing the grabber arms in an open position.

As best seen in FIGS. 3, 4 and 5, the grabber frame 46 has a lower pivot plate 118 provided with a collar 120 to which a base end 122 of the grabber piston cylinder 48 is pivotally mounted. A rod end 124 of the grabber piston cylinder 48 is pivotally connected to one side of a first grabber pivot 126 on the grabber arm 52. The grabber pivot 126 and the grabber arm 52 are pivotally mounted to the grabber frame 46 about a pivot pin 128 suitably retained such as by a set screw. The grabber arm 50 has a grabber pivot 130 which is pivotally mounted to the grabber frame 46 by a pivot pin 132 suitably held in place, such as by a set screw. A link 134 has one end 136 pivotally attached to one side of the grabber pivot 130, and another end 138 pivotally connected to the other side of the grabber pivot 126. Such arrangement enables movement of the grabber arms 50, 52 between opened and closed positions when the grabber piston cylinder 48 is actuated. The grabber arms 50, 52 are provided with respective face plates 140, 142. In addition, the grabber frame 46 includes a face plate 144 to which the chute 30 is attached. It should be noted that in FIGS. 2-4, 6-8 and 11-14, the grabber arms 50, 52 are shown in an extreme closed position such that the arms 50, 52 overlap. However, in practical use, the closed position is defined by the engagement of the arms 50, 52 with the side surfaces of a waste container 28.

An exemplary operation of the lifting arm assembly 14 follows with reference to FIGS. 1*a*, 1*b*, 1*c* and 6-14.

FIG. 1*a* illustrates the lifting arm assembly in a lowermost retracted position against the side of the refuse collection vehicle 10 with the grabber arms 50, 52 in the open position. In the lowermost retracted position, the first or innermost tooth valley 87 on the sprocket arms 38, 40 receives the lowermost roller 62 on the static frame 32 as depicted, for example, in FIG. 9. When it is desired to empty a filled waste container 28, the mechanism 26 is laterally extended towards the waste container 28. At the same time, the lift piston cylinder 64 is actuated to begin moving the sliding frame 36 within the static frame 32 causing an increased meshing engagement of the teeth 86 with a lower group of rollers 62 as the sprocket arms 38, 40, the control link 42, and the grabber structure 44 are moved forwardly. When the chute 30 engages the waste container 28, the grabber arms 50, 52 are brought into a closed position with the sides of the waste container 28 by actuating the grabber piston cylinder 48 as illustrated in FIG. 1*b*.

Figure 6:
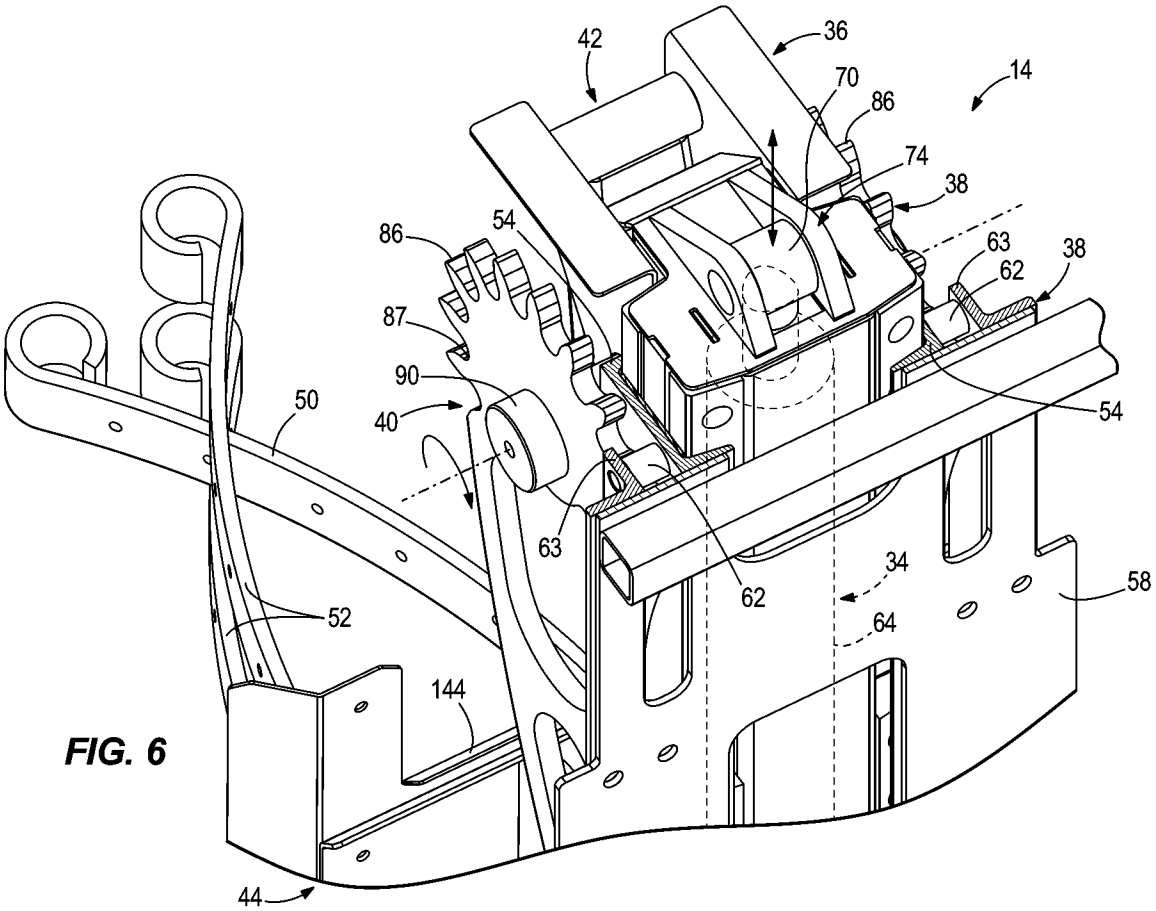
FIG. 6 is a fragmentary top perspective view of the lifting arm assembly taken from the rear thereof.
Figure 8:
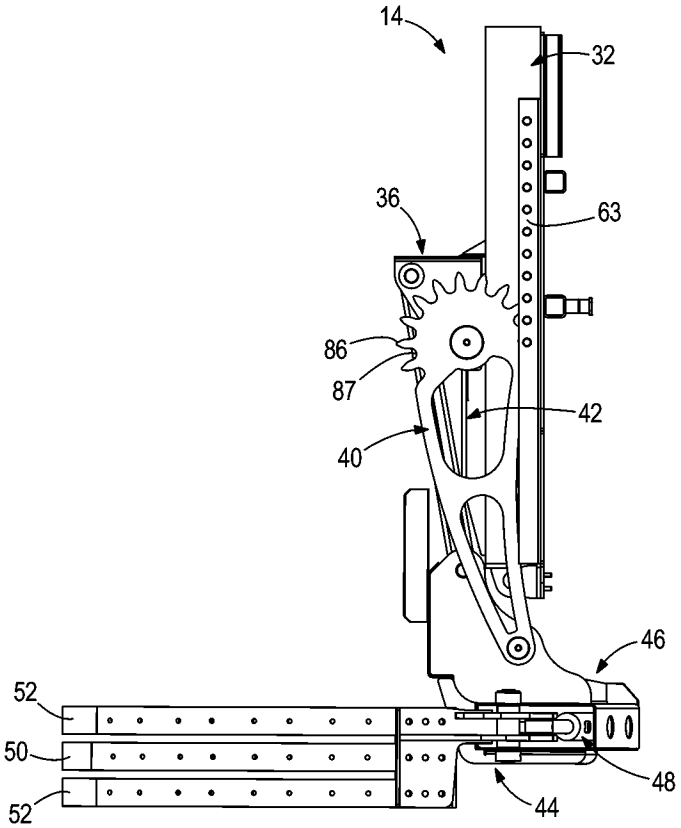
FIG. 8 is a side view of FIG. 7.
Figure 7:
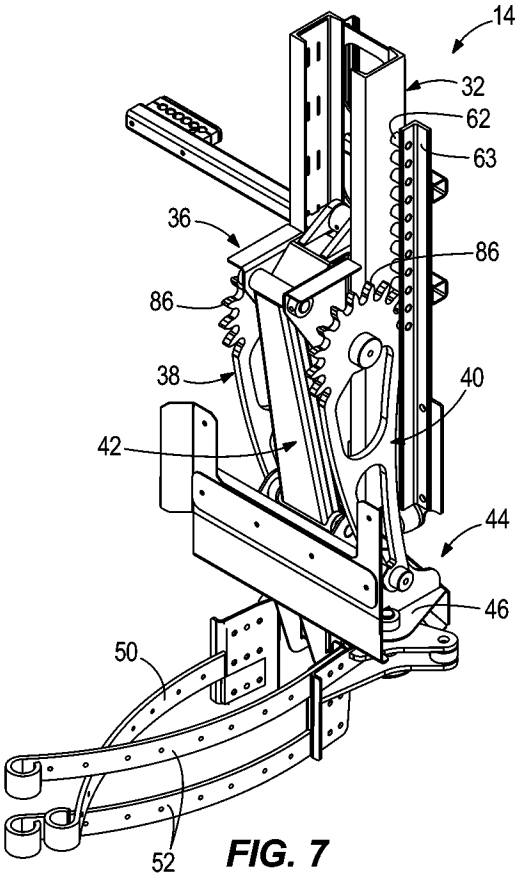
FIG. 7 is a front perspective view of the lifting arm assembly, shown in FIG. 2 in the lowermost position with the grabber structure in a closed position.
Figure 10:
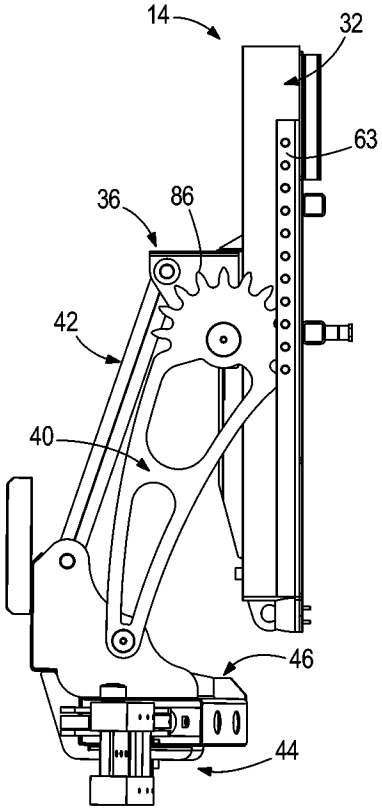
FIG. 10 is a side view of FIG. 9.
Figure 9:
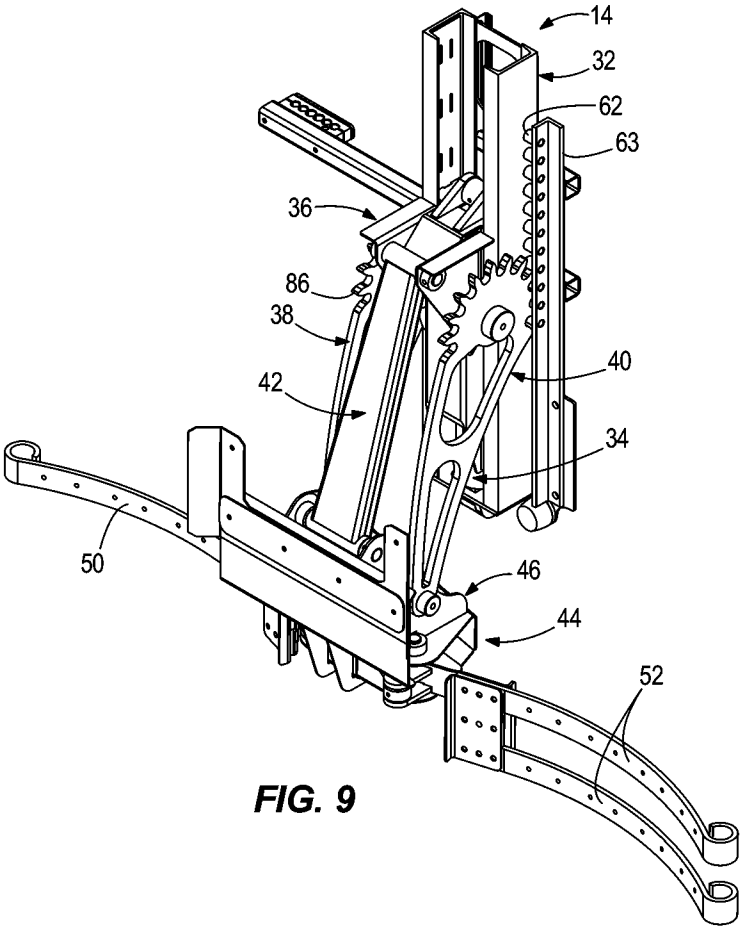
FIG. 9 is a front perspective view of the lifting arm assembly in the position of FIG. 7 showing the grabber structure in the open position.
Figure 11:
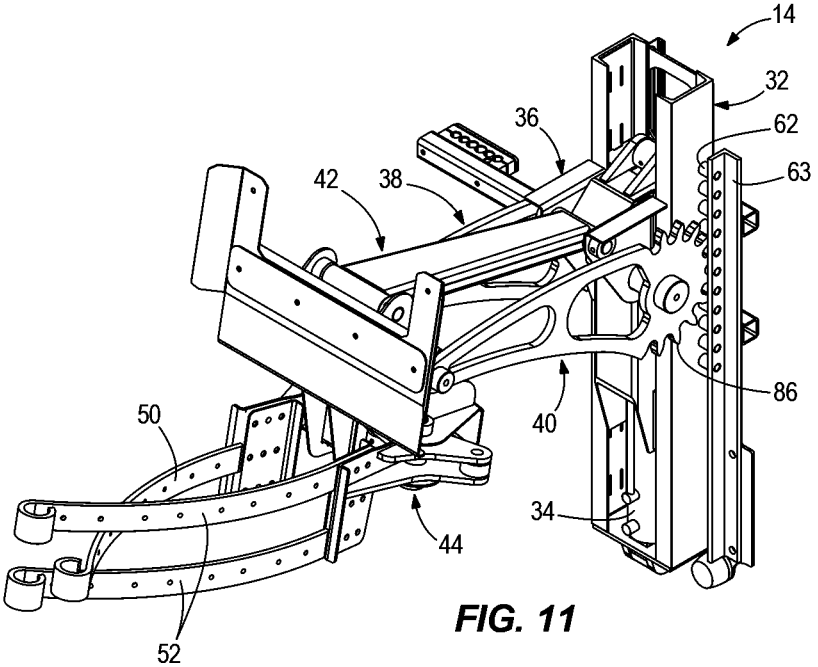
FIG. 11 is a front perspective view of the lifting arm assembly in a partially raised position.
Figure 12:
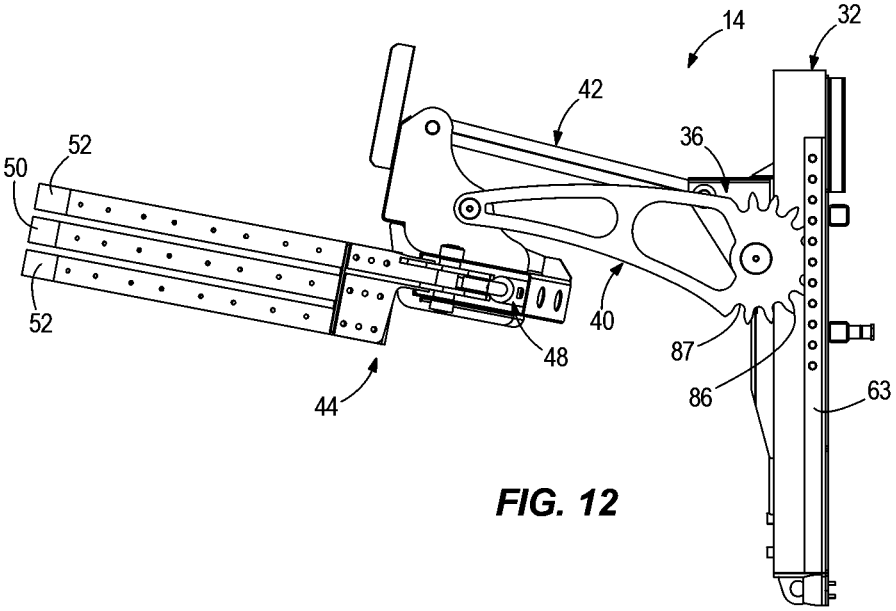
FIG. 12 is a side view of FIG. 11.
Figure 13:
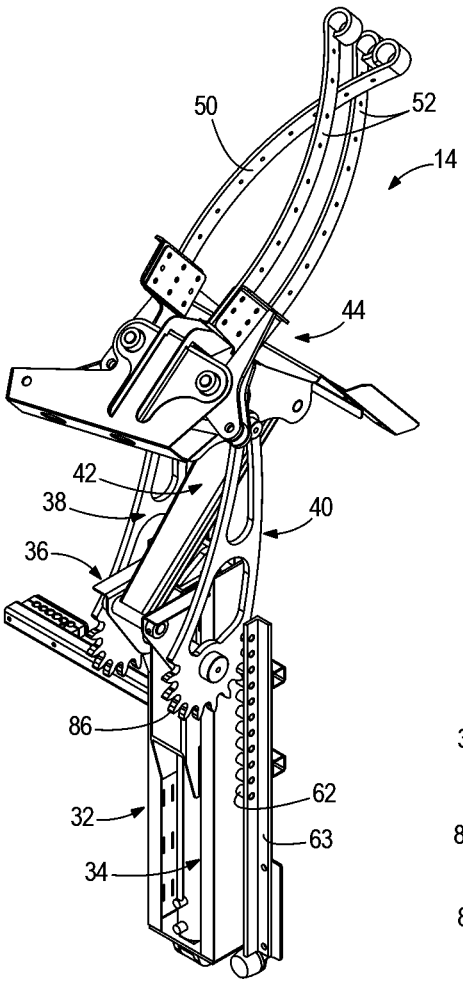
FIG. 13 is a front perspective view of the lifting arm assembly in an uppermost position with the grabber structure in the closed position.
Figure 14:
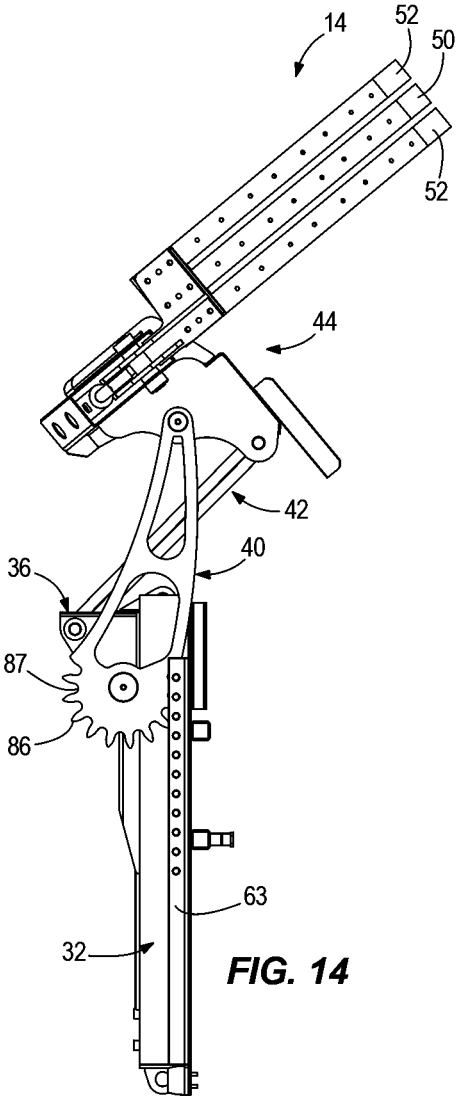
FIG. 14 is a side view of FIG. 13.

Continued actuation of the lift piston cylinder 64 results in progressive engagement of the teeth 86 with the middle portion of rollers 62, as depicted in FIG. 12, causing a combined pivoting and lifting movement of the sprocket arms 38, 40, the control link 42 and the grabber structure 44 engaged with the waste container 28. Such pivoting and lifting movement continues until the teeth 86 engage the uppermost portion of the rollers 62 as seen in FIGS. 6 and 14 to tip and dump the refuse contents of the waste container 28 into the hopper 22 of the refuse collection vehicle 10 as shown in FIG. 1*c*.

Operation of the lifting arm assembly 14 is reversed to return the emptied waste container 28 to its initial position. The grabber arms 50, 52 are released from the waste container 28 and the lifting arm assembly 14 is retracted to the position of FIG. 1*a* after which the refuse collection vehicle 10 can be moved to a different location to repeat the above described operation for emptying a different filled waste container 28.

Thus, it should be understood that the present disclosure relies upon a rolling meshing engagement of the sprocket arm teeth 86 of a linkage and drive arm arrangement 38, 40 with rollers 62 on a static frame 32 to provide an effective pivoting and lifting motion used in an automated side loader 12 during refuse collection. The interaction between the static frame 32, the sliding frame 36, the sprocket arms 38, 40, the control link 42 and the grabber structure 44 provides an efficient linkage geometry which results in improved stability and structural integrity of the lifting arm assembly 14, and requires a decrease in the forces previously required to provide cantilevered lifting during refuse collection. The lifting arm assembly 14 is designed to provide rapid and stable emptying of waste containers with a minimum of spillage during the emptying operation, and without any reliance on chains that previously required periodic adjustment.

It should be appreciated that certain components of the linkage geometry may be modified as desired. For example, the size of the valleys 87 between the teeth 86 of the sprocket arms 38, 40 and the size of the rollers 62 may be altered to provide a different pivoting and lifting motion. The present disclosure contemplates further changes and modifications without affecting the scope of the invention as defined in the claims.

What is claimed is:

1. A lifting arm assembly movable between a grabbing position and a tipping position, the lifting arm assembly comprising:

a static frame provided with a roller arrangement;

a dynamic frame mounted for vertical movement relative to the static frame;

a grabber structure provided with a pair of grabber arms configured for movement between a closed position and an open position; and a linkage arrangement having a first end pivotally connected to the dynamic frame, and a second end pivotally attached to the grabber structure, the first end including a set of teeth arranged in meshing engagement with the roller arrangement on the static frame, wherein movement of the dynamic frame relative to the static frame causes pivoting of the linkage arrangement resulting in lifting movement of the grabber structure along a curvilinear path between the grabbing position and the tipping position.

2. The lifting arm assembly of claim 1, wherein the static frame includes a pair of C-shaped channels connected to a bottom plate and a rear backward plate, and a pair of L-shaped channels fixed to the backward plate and spaced from the C-shaped channels.

3. The lifting arm assembly of claim 2, wherein the roller arrangement is formed by a series of vertically aligned rollers mounted between each C-shaped channel and each L-shaped channel.

4. The lifting arm assembly of claim 1, wherein a lift piston cylinder is mounted within the static frame, and includes a base end fixed to the static frame and an extendable and retractable rod end fixed to the dynamic frame.

5. The lifting arm assembly of claim 1, wherein the dynamic frame is provided with a first pair of spaced apart side plates.

6. The lifting arm assembly of claim 5, wherein a control link has an upper end pivotally mounted between opposed inside surfaces of the spaced apart side plates on the dynamic frame, and a lower end pivotally mounted to the grabber structure.

7. The lifting arm assembly of claim 6, wherein the linkage arrangement includes a pair of sprocket arms having upper ends pivotally mounted to outside surfaces of the side plates of the dynamic frame, and bottom ends pivotally attached to the grabber structure on opposite sides of the lower end of the control link.

8. The lifting arm assembly of claim 7, wherein the grabber structure includes a grabber frame having a lower pivot plate provided with a second pair of spaced apart side plates to which the bottom ends of the sprocket arms and the lower end of the control link are pivotally mounted.

9. The lifting arm assembly of claim 8, wherein a grabber piston cylinder has a base end pivotally connected on one end of the lower pivot plate, and a rod end pivotally attached to one side of a first grabber pivot on a first grabber arm.

10. The lifting arm assembly of claim 9, wherein the first grabber pivot is pivotally connected to the grabber frame.

11. The lifting arm assembly of claim 10, wherein a second grabber arm has a second grabber pivot pivotally connected to the grabber frame.

12. The lifting arm assembly of claim 11, wherein a link is provided between the first grabber pivot and the second grabber pivot.

13. A lifting arm assembly moveable between a grabbing position and a tipping position and adapted to be used in securing, lifting and emptying a waste container into a refuse collection vehicle, the lifting arm assembly comprising:

a static frame adapted to be secured to an extendable and retractable movement mechanism mounted on the refuse collection vehicle, the static frame being provided with a roller arrangement;

a dynamic frame slidably mounted for vertical movement within the static frame;

a grabber structure provided with a pair of grabber arms configured for movement between a closed position and an open position and adapted to engage the waste container;

a drive arm arrangement having a first end pivotally coupled to the dynamic frame and a second end pivotally joined to the grabber structure;

a control link having a first end pivotally attached to the dynamic frame and a second end pivotally secured to the grabber structure;

a first extendable and retractable piston cylinder mounted on the static frame for vertically moving the dynamic frame within the static frame, the first piston cylinder having a base end fixed to the static frame, and a rod end joined to the dynamic frame; and a second extendable and retractable piston cylinder mounted on the grabber structure for moving the grabber arms between the open and closed positions, wherein the first end of the drive arm arrangement is formed as a sprocket having a plurality of teeth arranged in meshing engagement with the roller arrangement on the static frame, and wherein actuation of the second piston cylinder is adapted to cause the grabber arms to engage the waste container and actuation of the first piston cylinder causes vertical movement of the dynamic frame within the static frame such that the control link and the drive arm arrangement are pivoted resulting in movement of the grabber structure along a curvilinear path between the grabbing position and the tipping position.

14. The lifting arm assembly of claim 13, wherein, in the grabbling position, the grabber arms are positioned below the static frame.

15. The lifting arm assembly of claim 13, wherein, in the tipping position, the grabber arms are positioned above the static frame.

16. The lifting arm assembly of claim 13, wherein the drive arm arrangement is formed by a pair of sprocket arms.

17. The lifting arm assembly of claim 13, wherein the dynamic frame includes a first pair of side plates defining separate pivotal mountings for the first end of the drive arm arrangement and the first end of the control link.

18. The lifting arm assembly of claim 13, wherein the grabber structure includes a second pair of side plates defining separate pivotal mountings for the second end of the drive arm arrangement and the second end of the control link.

* * * * *